US005085290A

United States Patent [19]

Guirlinger

[11] Patent Number: 5,085,290

[45] Date of Patent: Feb. 4, 1992

[54] FOLDAWAY STOOL MOUNTED TO INSIDE OF CABINET DOOR

[76] Inventor: Edward C. Guirlinger, 7170 E. Main St., Reynoldsburg, Ohio 43068

[21] Appl. No.: 658,493

[22] Filed: Feb. 21, 1991

[51] Int. Cl.[5] ..... E06C 9/00

[52] U.S. Cl. ..... 182/77; 182/96; 182/91

[58] Field of Search ..... 182/77, 91, 86, 97, 182/33.5, 96; 297/433, 436, 425, 426; 312/235.1

[56] References Cited

U.S. PATENT DOCUMENTS

| | | | |
|---|---|---|---|
| 2,555,149 | 5/1951 | Mushta . | |
| 2,581,488 | 1/1952 | Keltner et al. | 182/77 |
| 2,801,894 | 8/1957 | MacInnes . | |
| 2,881,040 | 4/1959 | Hartridge | 182/97 |
| 3,026,144 | 3/1962 | Clarin | 297/425 |
| 3,030,166 | 4/1962 | Richards et al. | 182/96 X |
| 3,102,757 | 9/1963 | Higgins | 297/426 |
| 3,136,386 | 6/1964 | Horvath et al. | 182/96 X |
| 3,481,429 | 12/1969 | Gaede | 312/235.1 X |
| 3,756,678 | 9/1973 | Kloppenstein . | |
| 3,833,089 | 9/1974 | Backwell | 182/91 |
| 4,135,604 | 1/1979 | Ryan | 182/91 |
| 4,846,304 | 7/1989 | Rasmussen . | |

*Primary Examiner*—Karen J. Chotkowski

*Attorney, Agent, or Firm*—Townsend and Townsend

[57] ABSTRACT

A foldaway step device for use in conjunction with a cabinet door, having a mounting plate (25) which is fixedly secured to the lower portion of the door (18), a step surface (37), legs (42), (43), (44) and (45), linkages (30) and (31), and a handle (55) which work in conjunction with and are pivotally connected to the plate (25). The step is stored flatly and verticaly on the inside of the door (18) in a manner which allows for normal use of the cabinet and unobstructed access to its contents. The step is lowered into its use position by opening the door (18) and pulling the handle (55) out and down in a 90° circular motion. This action causes the step surface (37) to be lowered ot a horizontal position with the legs (42) to (45) extended vertically below it to a touching engagement with the floor. The step is stored with an action exactly the opposite.

11 Claims, 7 Drawing Sheets

FOLDAWAY STOOL MOUNTED TO INSIDE OF CABINET DOOR

The subject matter herein was described in a Disclosure Document filed with the U.S. Patent and Trademark Office on Jan. 17, 1991, Ser. No. 271,559, entitled "Hide-a-Step."

BACKGROUND OF THE INVENTION

This invention relates in general to foldable step stools for use mainly in the kitchen and bathroom, and more specifically to a foldaway stool system mounted to the inside of a cabinet door and unfolded therefrom to provide a step area large enough for both feet and high enough to be useful. When the step is not in use, it is folded away flat against the inside of the cabinet door, within the outer dimensions of the cabinet opening allowing the door to shut completely.

The need for step stools to help people reach items in the kitchen and bathroom has long been established. Small adults need a stool to reach items on the upper shelves of cabinets in the kitchen and young children need a stool to reach items on the counter top, mainly the sink in the kitchen and bathroom. According to the 1989 Statistical Abstract of the United States, there are approximately 110 million people in the United States whose height is 5 feet, 4 inches, or below, there are more than 14.5 million children in the U.S. between the ages of two and six years, and there are more than 60 million households in the U.S. in which stools of this nature are needed. It is obvious from this information that the need for step stools is one that directly affects a large portion of the United States' population, and indirectly affects the remaining portion through its association with family and friends who are of direct need.

The need for and use of stools in the U.S. is indisputably great. Thus, so are the problems which are commonly associated with using them. One problem in particular is what to do with the stool when it is not in use. Presently, there is no simple, affordable, universal solution available. When not in use, stools are commonly left on the floor where they cause an annoying clutter problem and a dangerous trip hazard. If the stool is stored when not in use, it takes up valuable storage space and becomes inconvenient to use.

This invention directly solves the clutter and storage problem. While it provides a large, sturdy step in the needed places, as do standard step stools, when not in use it folds conveniently away flat against the inside of nearly any cabinet door. It is designed specifically to be easy to install, simple and convenient to use, inexpensive, and usable in conjunction with nearly any cabinet door.

The apparent significant need by consumers for a foldable step stool of this nature is further proven by the large number of published ideas directed toward solving this problem. Many of these ideas are discussed below.

Heretofore, attempts to solve the problems associated with using standard step stools fall, basically, into five categories:

1. Foldable step units which are mounted to the inside of a cabinet door. This is the category in which my invention falls. One other design in this category is the step unit in U.S. Pat. No. 3,136,386 to Harvath and Jung (1964). The foldaway step of this patent requires a mounting bracket which extends substantially the length of the cabinet door. Two of the legs for the step are attached right at the cabinet door and extend downward when the step is extended. Since the legs need to retract up above the bottom of the cabinet door, the length of the legs limits the size of the step surface, which must retract to a position above these legs. The step unfolds in two motions, first unfolding the step, and second sliding it down to the floor.

2. Foldable step units stored under the cabinet behind the kickplate. One step of this type is shown in U.S. Pat. No. 3,481,429. It is necessary to modify the structure of cabinet for installation of this step. There are several steps involved in deploying and storing this step.

3. Foldable step units mounted to the outside of a cabinet door. U.S. Pat. Nos. 2,581,488, 3,030,166, and 3,833,089 represent this type of foldaway step. These step units are designed to mount to the outside of a cabinet door.

4. Collapsible step units that attach to the underneath side of a lower cabinet shelf. U.S. Pat. Nos. 2,801,894 and 4,846,304 show this design. This step design requires a shelf to be mounted to, thus there are only certain cabinets which it can be mounted in.

5. Noncollapsible step stools which fold in and out of cabinet space. Two examples are U.S. Pat. Nos. 2,881,040 and 4,135,604.

SUMMARY OF THE INVENTION

The present invention provides a collapsible, foldaway step which can be attached to the inside of a cabinet door. A support is attached to the cabinet door with the step surface being pivotally attached to the support. Pivoting legs are attached to the far end of the step and to a midpoint of the step. When in the folded position, the legs and the step surface are substantially flush with the cabinet door.

The design of the present invention allows the support to be attached only near the bottom of the cabinet door where there is a strong frame allowing attachment in most cabinets. Since one pair of legs is at the midpoint of the step, rather than at the end such as in the prior art '386 patent described above, the leg does not inhibit the folding of the step surface against the cabinet, allowing a larger step surface to be used.

Preferably, a handle is attached to the outer legs and is also attached to a linkage member which attaches to the midpoint pair of legs at a second pivot point. Thus, by simply lifting and pushing on the handle, it will cause the outer legs in the step to fold upward while at the same time, through a pivoting motion, forcing the midpoint legs to fold as well.

Accordingly, several objects and advantages of my invention are:

(a) To provide a foldaway step unit for use in conjunction with kitchen and bathroom cabinetry which is novel and effective in its approach to eliminating the clutter, storage and convenience problems common to the use of standard foldable and nonfoldable step units.

(b) To provide a foldaway step unit which can be quickly and easily fixedly mounted to the inside of almost any cabinet door (approximately 95% of kitchen and bathroom cabinets in use in the U.S.) by the use of only two screws driven into the frame of the door and foam mounting tape, while requiring no modification of the cabinet.

(c) To provide a foldaway step unit for use in conjunction with the cabinetry in the kitchen and bathroom which has only one motion necessary to its deployment and storage, making it extremely simple to use and thus allowing nearly anyone above the age of three years to effectively and safely use it.

(d) To provide a foldaway step unit for use in conjunction with the kitchen and bathroom cabinetry which is comparably priced with standard, foldable and nonfoldable step stools presently on the market and much less expensive than any foldable step concept intended to solve the same problems either on the market or not.

(e) To provide a foldaway step which is fixedly mounted to, stored on, and deployed from the inside of a cabinet door and, while being such, applying no significant stress to the cabinet door or its hinges.

(f) To provide a foldaway step unit to be used in conjunction with kitchen and bathroom cabinetry, which when deployed provides a sturdy step area large enough for both feet and high enough to be useful (e.g., at least 25 cm.), while still being able to fold inconspicuously against the inside of nearly any cabinet door, allowing the door to open and shut normally.

(g) To provide a foldaway step unit attached to the inside of a cabinet door which is light in weight so as to require little effort to operate and place no significant stress on the door or its hinges while in storage.

(h) To provide a foldaway step unit which, while having all of the indicated features, is extremely simple in its design having very few parts all of which are simple and inexpensive to manufacture.

(i) To provide a foldaway step unit to be used in conjunction with kitchen and bathroom cabinetry which is stored vertically on the inside of a cabinet door occupying an area normally not used and in no way affecting normal usage of the cabinetry or access to its contents.

(j) To provide a foldaway step unit which limits safety hazards common to the use of step units in general with concentration on: sturdiness, nonslip texturing of the step surface, reduction of pinch hazards and reduced potential for toe and finger smashing.

(k) To provide a foldable step unit for use in conjunction with kitchen and bathroom cabinetry which is extremely strong and durable, being designed to handle many times the force that will be applied to it during normal usage.

(l) To provide a foldable step unit for use in conjunction with kitchen and bathroom cabinetry which has a significantly larger market potential than any similar concept, due mainly to the following facts: The invention of this application is easier to install, more simple and safe to use, thus making it usable by more people, cheaper to produce and more universal in its application, fitting nearly 95% of the kitchen and bathroom cabinets in use in the United States. Further objects and advantages of my invention will become apparent from a consideration of the description and drawings.

DESCRIPTION OF THE SPECIFIC EMBODIMENT(S)

One of many possible embodiments of my invention is illustrated in FIGS. 1 to 7. This particular version referred to as the first embodiment uses wood as the main medium of construction. Its static physical structure is described herein as the step unit stands on its legs in its unfolded, use position (as is pictured in FIGS. 2, 4 and 6A).

Figure 1:
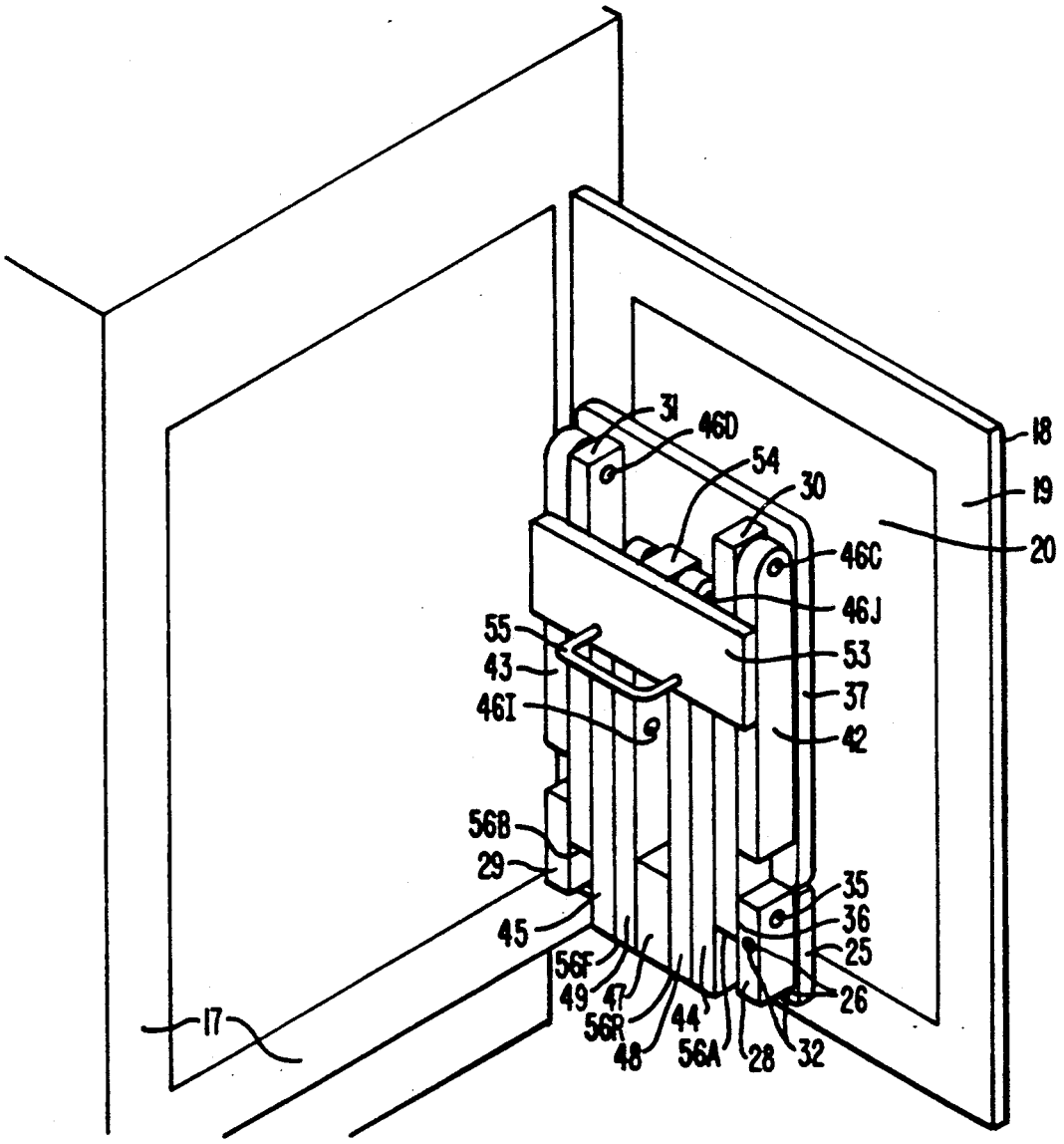
FIG. 1 shows a perspective view of a first embodiment of the step mounted to and folded flat against the inside of a cabinet door.
Figure 2:
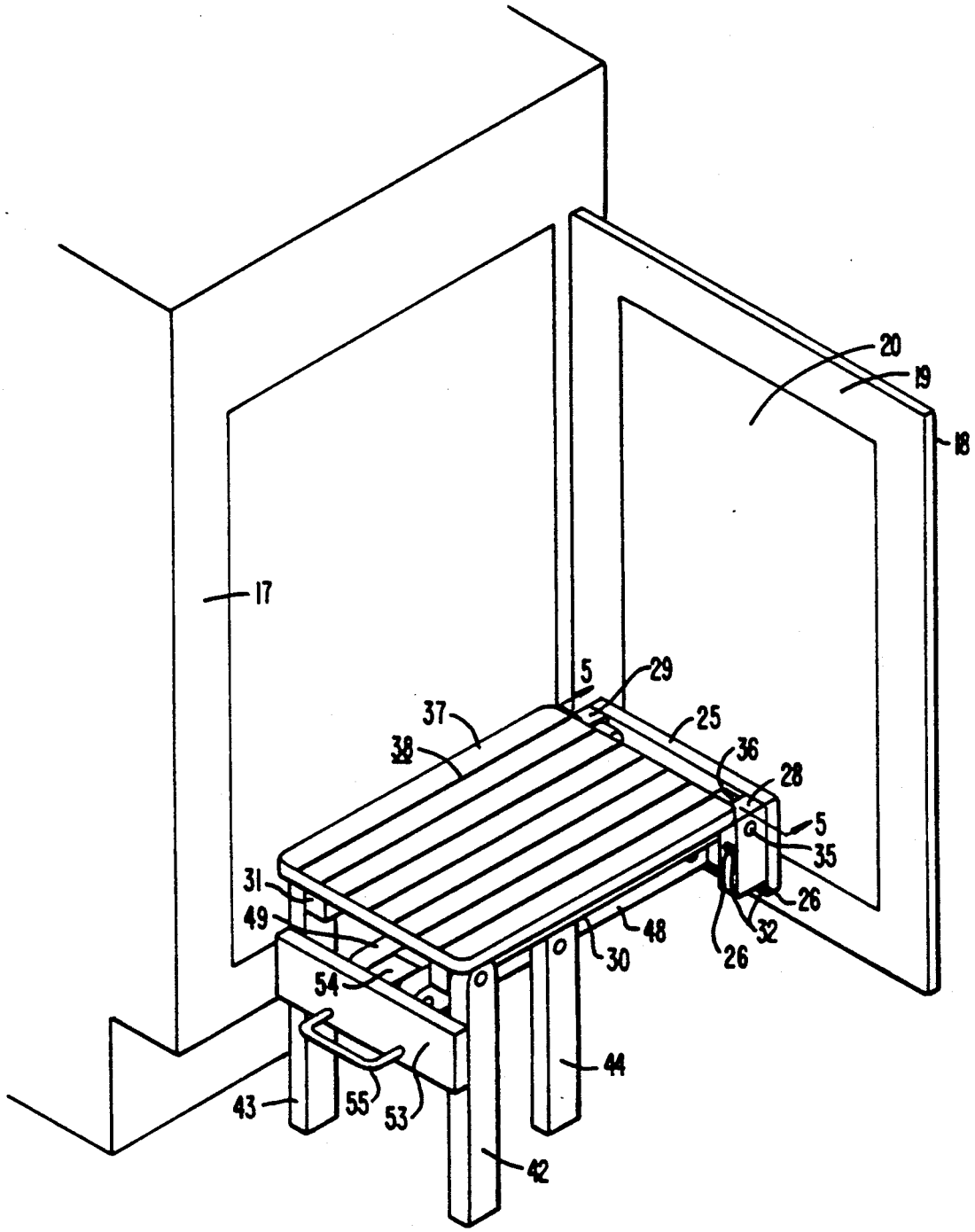
FIG. 2 shows a perspective view of the first embodiment unfolded into its use position.
Figure 3:
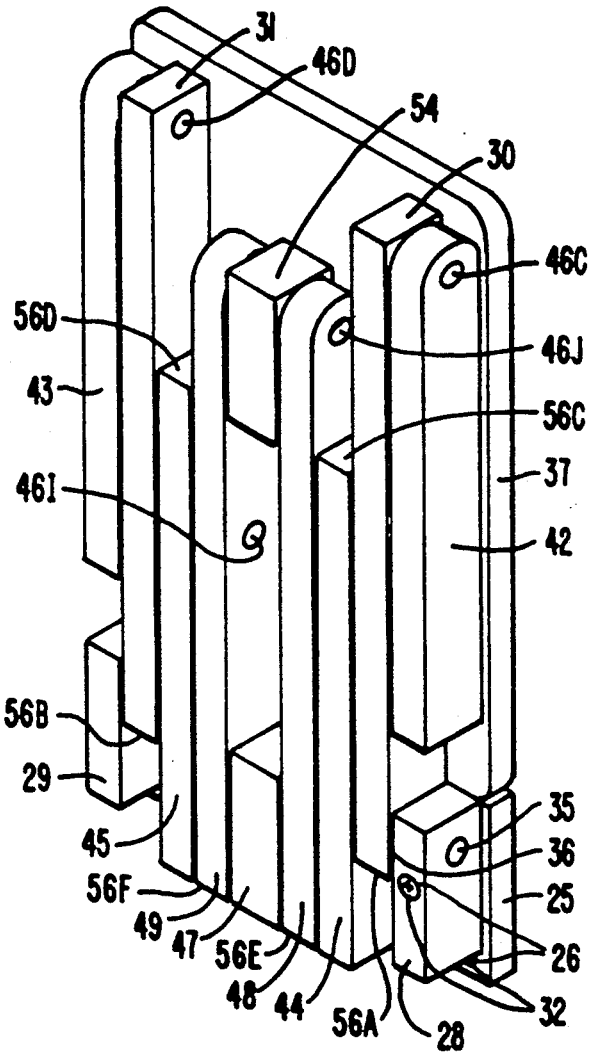
FIG. 3 shows a perspective view of the first embodiment in its folded, storage position with the front plate removed.
Figure 7:
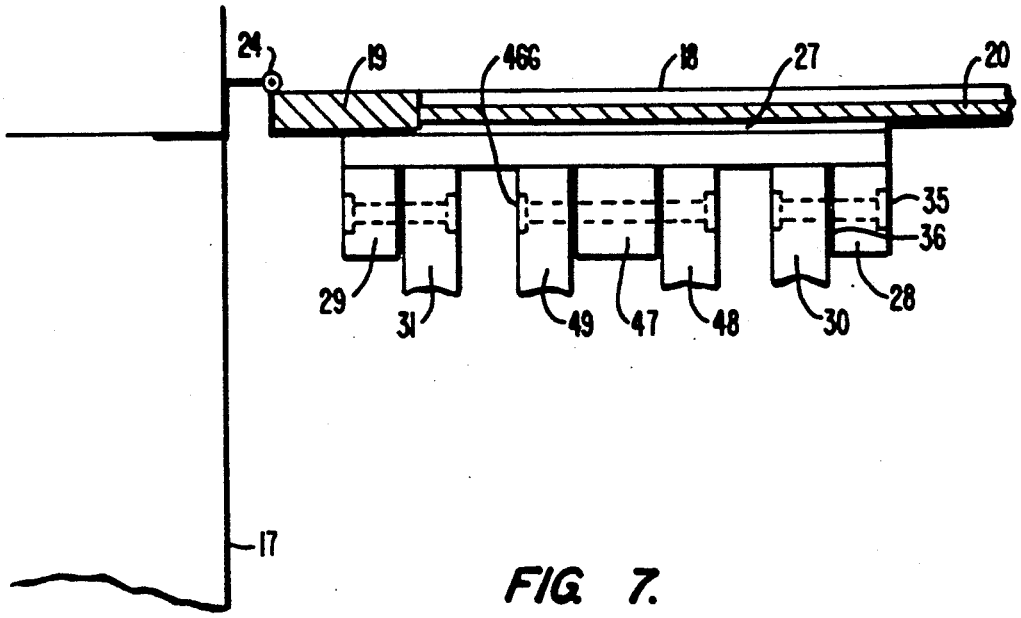
FIG. 7 shows a detailed top view of the first embodiment's mounting plate attached to a cabinet door which is shown in section.
Figure 5:
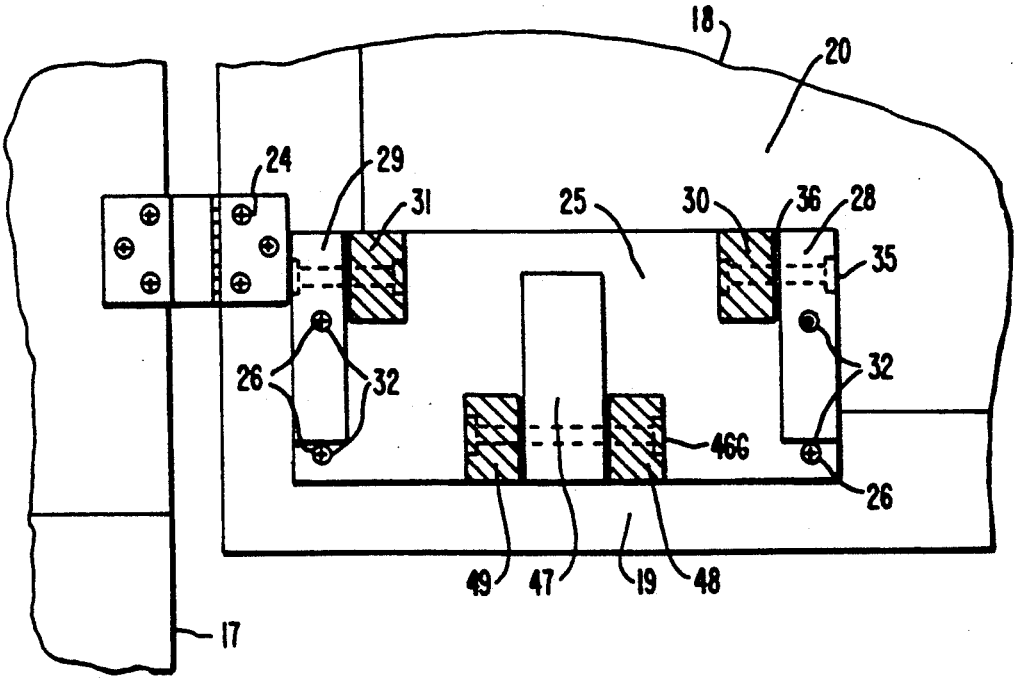
FIG. 5 is a sectional view taken along line 5—5 in FIG. 4 to show details of the mounting plate.

The first embodiment of my invention as shown in FIG. 1 comprises a mounting plate 26 which is fixedly secured to the lower inside corner of a vertically oriented cabinet door 18 as is best shown in FIGS. 2, 5 and 7. The plate 25 is secured to the door by two to four screws 26 which are driven into the door frame 19 only, and by foam mounting tape 27 used between the plate 25 and the door 18.

Figure 4:
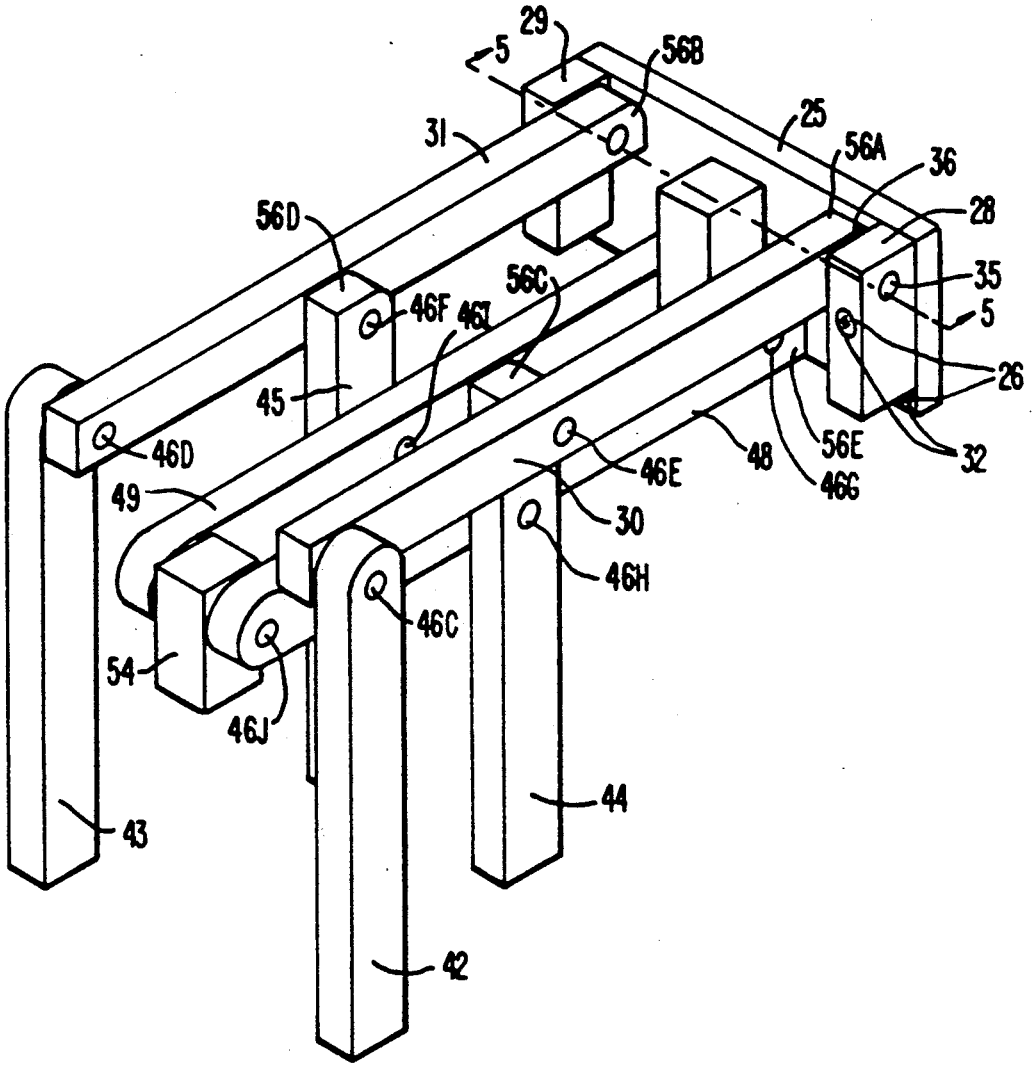
FIG. 4 shows a perspective view of the first embodiment unfolded into its use position with the step surface and front plate removed.

As is shown in FIGS. 4 and 5, the plate 25 has fixedly secured to the upper right and left corners of its front face a right pivot block 28 and a left pivot block 29 from which extend horizontally a right step surface support 30 and a left step surface support 31. The supports 30 and 31 are substantially equal in length, parallel to each other and their top surfaces are even with the top edge of plate 25. They are also substantially perpendicular, both vertically and horizontally, to the plate 25. The supports 30 and 31 are pivotally connected to their respective pivot blocks 28 and 29 by pivot pins 35 with pivot point washers 36, for spacing and friction reduction, sandwiched in between. This pivot pin and pivot point washer arrangement is common to all pivot points in this embodiment.

Figure 6B:
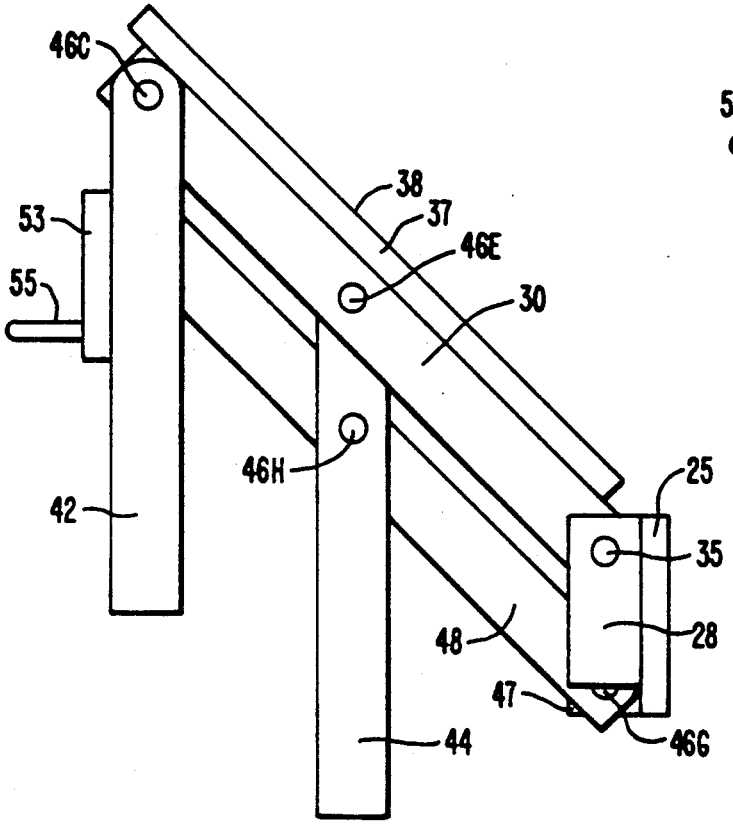
FIG. 6A to 6C show side views of the first embodiment in various stages of deployment with FIG. 6A showing full deployment, FIG. 6B showing partial deployment, and FIG. 6C showing full storage.
Figure 6C:
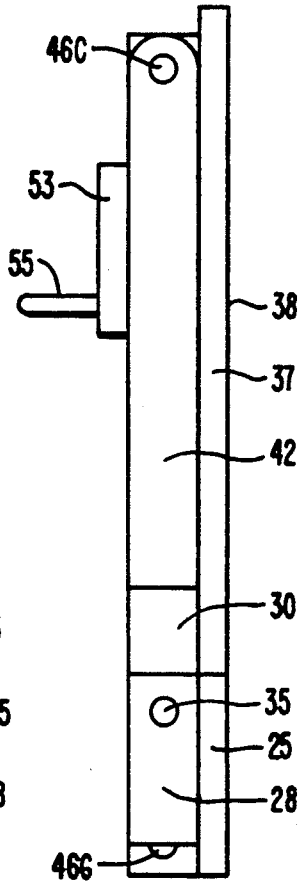
Figure 6A:
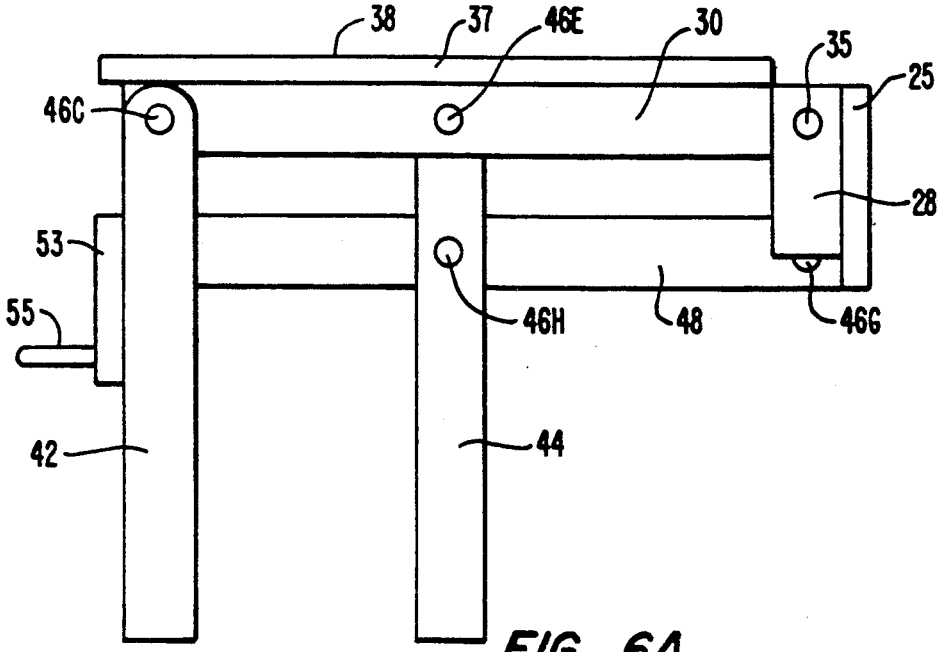

As is shown in FIGS. 2 and 6A, a step surface 37 is fixedly secured to the upper edges of the two horizontally outstretching supports 30 and 31, thus causing the step surface 37 to also be horizontally oriented. The step surface 37 has a nonslip, step surface texturing 38 on its upper surface to help eliminate any slip hazards.

As is best show in FIGS. 2 and 4, four legs 42, 43, 44 and 45, substantially equal in length, stretch, in a substantially parallel relationship, vertically downward from pivot points 46C, 46D, 46E and 46F in the outstretching horizontal supports 30 and 31 to a touching engagement with the floor. In more detail, the right front leg 42 is pivotally secured to the front most right side of the right support 30 at a pivot point 46C. The left front leg 43 is pivotally secured to the front most left side of the left support 31 at a pivot point 46D. The right rear leg 44 is pivotally secured at a midpoint on the left side of the right support 30 at a pivot point 46E. The left rear leg 44 is pivotally secured at a midpoint on the right side of the left support 31 at a pivot point 46F.

The two pivot points 46C and 46D are equidistant from the plate 25 as are also the pivot points 46E and 46F.

Also best shown in FIGS. 2 and 4, a rear center pivot block 47 is fixedly secured in a vertical orientation to the center of the plate 25 on its front face with the bottom surface of the block 47 being even with the bottom edge of plate 25. A right linkage element 48 and a left linkage element 49 extend horizontally from a common pivot point 46G in block 47. The linkages 48 and 49 are positioned approximately 5 to 10 cm. below the supports 30 and 31, and are substantially parallel and equal in length to both each other and the supports 30 and 31. The legs 42, 43, 44, and 45 are secured to and stabilized by the linkage elements 48 and 49 at pivot points 46H, 46I and 46J. These points 46H, 46I and 46J, corresponding to equal midpoints in each leg, are all substantially equal in distance from the plate 25 as their corresponding pivot points 46C, 46D, 46E and 46F are in the top of each leg. This means that the linkages 48 and 49 and the supports 30 and 31 are nearly identical in construction with respect to their length and the placement of the above-mentioned pivot points.

The right rear leg 44 is pivotally secured at a midpoint in the leg to the right side of the linkage 48 at a pivot point 46H. The left rear leg 45 is pivotally secured at a midpoint in the leg to the left side of the linkage 49 at a pivot point 46I.

As is shown best in FIG. 2, a front plate 53 is fixedly secured at equal midpoints to the front faces of both front legs 42 and 43. This structural relationship provides additional side-to-side stability to the front legs 42 and 43. A front center pivot block 54, shown in FIG. 4 with the front plate 53 removed, is fixedly secured in a vertical orientation to the center of the plate 53 on its inside surface. The front portions of linkages 48 and 49 connect to the block 54 at a common pivot point 46J. This connecting relationship provides front-to-back stability to the front legs 42 and 43.

A handle 55 extends horizontally from the lower center portion of the front face of plate 53, best shown in FIG. 2. It is by this handle that the step is unfolded for use and folded for storage.

Over-extension stop points 56A to 56F, best shown in FIG. 4, are half-rounded features located on the back ends of the supports 30 and 31 and the linkages 48 and 49 near the plate 25 and also at the top of the rear legs 44 and 45. These features are designed to keep the step from unfolding beyond the 90 point of its normal use position.

It is seen in FIGS. 1, 3, 5, 6B and 6C that when the step is folded into its storage position, the legs 42, 43, 44 and 45, the supports 30 and 31, the linkages 48 and 49, and the pivot blocks 28, 29, 47 and 54 will lie vertically flat against both the step surface 37 and the plate 25 in a side-by-side relationship with the front plate 53 and handle 55 lying horizontally over an upper portion of the folded parts.

Figure 8:
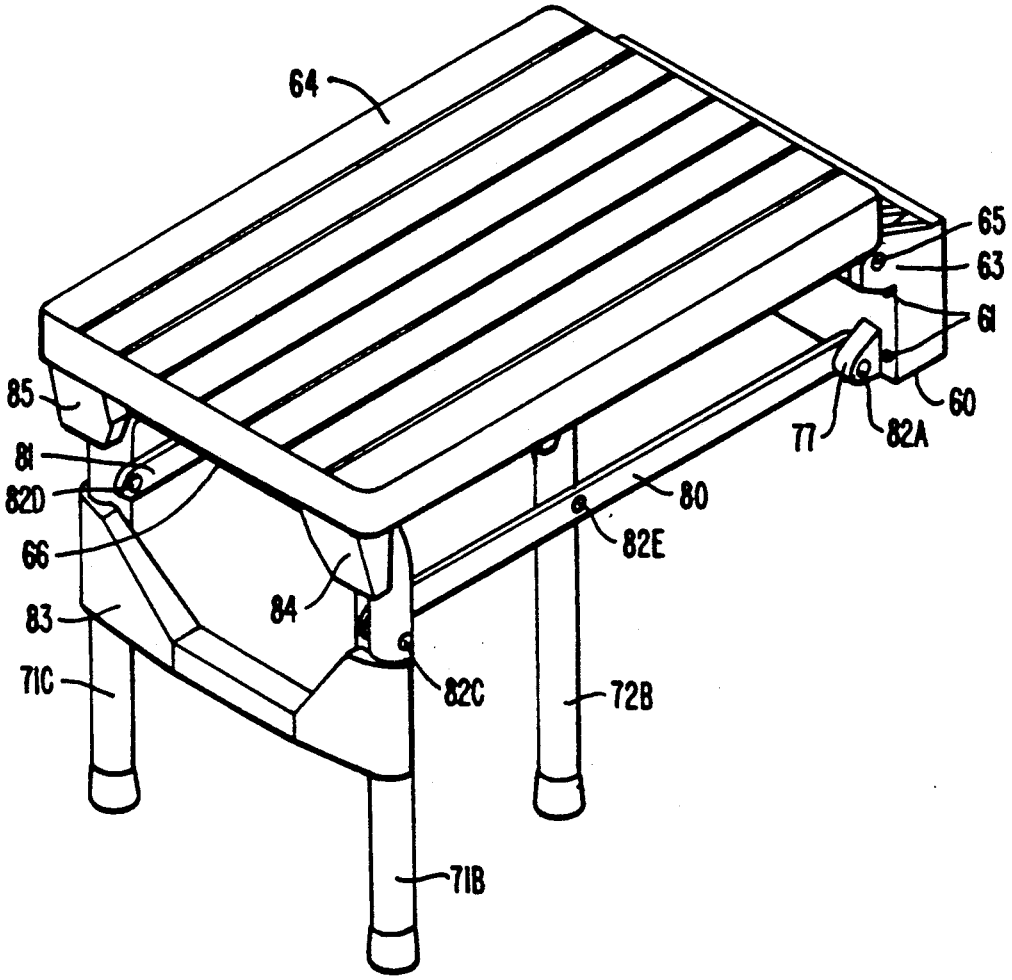
FIG. 8 shows a perspective view of the second embodiment unfolded into its use position.

The second version of my invention illustrated in FIG. 8 is referred to as the second embodiment which uses plastic and metal as the main mediums of construction. Its static physical structure is described herein as the step stands on its legs in its unfolded, use position.

The second embodiment is mounted in much the same way as the first embodiment (consult FIGS. 2 and 7). It comprises a mounting plate 60 which is fixedly secured to the lower inside corner of a vertically-oriented cabinet door. The plate 60 is secured to the door by two to four screws 61 which are driven into the door frame only, and by foam mounting tape between the plate 60 and the door.

The plate 60 has molded into its upper edge half of a hinge system 63. A step surface 64 has molded into its back edge the other half of hinge 63. A series of hinge pins 65 pivotally secure the two halves of hinge 63, thus making a pivotal connection between the plate 60 and the step surface 64.

The step surface 64 extends horizontally from the hinge 63 and the plate 60. The bottom surface of the step surface 64 has molded into, and extending downward from it a front leg clip 66 which is centered side-to-side at the front of the step surface 64, and a rear leg clip 67 which is shorter than clip 66 and centered at a front-to-back midpoint on the underside of the step surface 64.

A front leg unit 71 consisting of a crossbar 71A and two legs, a right front leg 71B and a left front leg 71C, which extend parallel to each other and at right angles to the bar 71A, is engaged rotatably in the clip 66 at the crossbar 71A. A rear leg unit 72 consisting of a crossbar 72A and two legs, a right rear leg 72B and a left rear leg 72C which extend parallel to each other and perpendicular to the crossbar 72A, is engaged rotatably in clip 67 at the crossbar 72A. The crossbar 72A is short enough to allow the outside dimension, leg to leg, of the leg unit 72 to be at least 2 cm. shorter than the inside dimension, leg to leg, of leg unit 71. This allows leg unit 72 to fit flatly inside the legs of leg unit 71 when the step is in its folded, storage position.

When the step is in its use position, shown in FIG. 8, the legs of both leg units 71 and 72 are substantially perpendicular to the step surface 64. Both leg units 71 and 72 are held in substantially centered positions, in relation to the sides of the step, while engaged in their corresponding clips 66 and 67 by a centering groove 73 and 74 encircling the center of both crossbars 71A and 72A. These grooves 73 and 74 meet with a front clip raised area 75 and a rear clip raised area 76 on the inside surface of the clips 66 and 67, disallowing side-to-side movement of the leg units 71 and 72 in their corresponding clips 66 and 67.

A right pivot block 77 which is molded into the bottom right corner of the plate 60 and a left pivot block 78 which is molded into the bottom left corner of the plate 60, protrude frontward from the front surface of plate 60. A right linkage element 80 extends horizontally from a linkage pivot point 82A in block 77 and a left linkage element 81 extends similarly from a linkage pivot point 82B in block 78. The linkages 80 and 81 are positioned approximately 5 to 15 cm. below the step surface 64 and are substantially parallel and equal in length. The legs 71B, 71C, 72B and 72C are secured to and stabilized by the linkages 80 and 81 at linkage pivot points 82C at a midpoint in the right front leg, 82D at a midpoint in the left front leg, 82E at a midpoint in the right rear leg and 82F at a midpoint in the left rear leg. All linkage pivot points 82A to 82F are on the same plane which is parallel to the step surface 64. The linkages 80 and 81 provide front-to-back stability to the legs 71B, 71C, 72B and 72C and secures them in a substantially perpendicular relationship to the step surface 64.

A handle 83 is fixedly secured at equal midpoints to the front faces of both front legs 71B and 71C. This handle 83 provides additional side-to-side stability to the front legs 71B and 71C, and it is by this handle 83 that the step is unfolded for use and folded for storage.

A right front leg stop 84, a left front leg stop 85, a right rear leg stop 86 and a left rear leg stop 87 are molded into and extended down from the bottom surface of the step surface 64. The stops 84 to 87 are designed to keep the step from unfolding beyond its normal use position by engaging the upper most portion of each leg 71A, 71B, 72A and 72B and disallowing them to move beyond a position greater than 90 from their storage position flat against the bottom surface of the step surface 64.

When the step is folded into its storage position, the leg units 71 and 72, and the linkages 80 and 81 will lie vertically flat against, and parallel to both the step surface 64 and the plate 60 in a side-by-side relationship, with the handle 83 lying horizontally over an upper portion of the folded parts.

Both the first and second embodiments previously described have essentially the same installation procedure and method of operation, so the following description of these aspects will apply to both embodiments. All figure and part numbers referenced herein will be of the first embodiment.

To properly mount the step to the inside of a cabinet door, the step must be in its unfolded use position with the legs 42, 43, 44 and 45 and the mounting plate 25 extending perpendicular to the step surface 37 (refer to FIG. 2). The cabinet door 18 must be opened to a position substantially perpendicular to the front face of the cabinet structure 17. Foam mounting tape 27 is then applied to the rear surface of the plate 25. With the step sitting flatly on its legs 42 to 45, with the plate 25 facing toward the inside of the door 18, it is slid over and adhered to the hinged side, lower corner of the door 18, via the foam tape 27. It should be positioned as shown in FIGS. 5 and 7 with the edge of the plate 25 closest to the door hinges 24 being approximately 2 to 3 cm. from the side edge of the door 18. This positioning is necessary to allow the screws 26, used for mounting, to be positioned over the door frame 19.

It is important that the plate 25 be mounted in a vertical plane parallel to the plane of the door 18. Due to the fact that the center of the inside surface of some cabinet doors is indented (surface 20) from the inside surface of the surrounding door frame 19, see FIG. 7, it is necessary to use additional mounting tape 27 to fill in the space created between the plate 25 and the indented door surface 20.

Once the plate 25 is adhered to the door 18 in the proper position, it must be additionally secured by screws 26 driven through the mounting holes 32 in the plate 25 and into the door 18. Refer to FIGS. 2 and 5. There are basically two different types of cabinet doors which require two different screw fastening patterns. The first type of door is one that has an essentially uniform thickness, approximately 1.25 cm. In the case of mounting the step to such a door, the screws 26 can be driven through all four mounting holes 32 in the plate 25 into the door 18, securing the step firmly. The second type of door, depicted in FIGS. 2, 5 and 7, involves a door frame 19 which is generally 5 to 7 cm. wide and approximately 1.25 cm. thick. This frame 19 has a door material 20 spanning inside it which is thinner than the frame 19 or has thin spots in it, in some cases as thin as 0.5 cm. In this case, the door material 20 inside the frame is too thin to have the screws 26 driven into it, so it becomes necessary to avoid driving the screws 26 through any mounting holes 32 which are over a thin area in the door 18. If the step is always positioned in the manner described above the mounting holes 32 in the plate 25 closest to the door hinges 24 will nearly always be over the door frame 19, which is generally thick enough to receive the screws 26. The screws 26 should be placed in these two holes 32 and driven into the door frame 19. These two screws 26 in conjunction with the foam tape 27 are all that is necessary to safely and securely mount the step to any door, but if the other two mounting holes 32 should happen to be over an area in the door thick enough to receive the screws 26, then they too should be inserted.

After the step is mounted to the door in the above-described manner, it is ready for use. To use the step starting with the cabinet door 18 closed, one should open the door 18 to a point nearly perpendicular to the cabinet face 17, as shown in FIG. 2. Then, while holding the door 18 with one hand, grab the handle 55 of the step with the other hand and pull out and down away from the door 18 in a simple 90° circular motion. As this is done, the legs 42 to 45 of the step will automatically fold out to engage the floor, and the step surface 37 will be positioned horizontally over the floor above the legs. This opening sequence is depicted in FIGS. 6A to 6C.

At this point, the step is ready for use in the same manner in which a person would use any standard non-foldable step device. The person steps up onto the step surface 37, reaches what they need and steps down.

To fold the step away for storage, the above method of folding out for use is reversed. With one hand on the door 18 the person grabs the handle 55 with the other hand and pulls up and inward to the door in a simple 90° circular motion. When the step is positioned vertically flat against the inside of the door 18, the door 18 is closed in its normal fashion.

Accordingly, the reader will see that the foldaway step of this invention provides unique, effective, commercially viable solutions to the commonly-experienced clutter and storage problems associated with the use of standard foldable and nonfoldable step devices in the kitchen and bathroom. It has been shown that the step described in this application not only effectively solves these very common problems, but it does so with a foldaway step design which is easier to install, more simple and safe to use, less expensive to produce and more universal in its applications than any of the related prior art items I have discovered. All of this allows this invention to be realistically usable by more people in more places, thus having significantly greater market potential than any previous idea directed toward solving these problems.

While my above description contains many specificities, these should not be construed as limitations on the scope of the invention, but rather as an exemplification of two preferred embodiments thereof. Many other variations are possible. For example, the parts involved in this invention can be made from nearly any semi-rigid or rigid material such as many plastics, metals, woods and composite materials. The parts thereof may also have many alternative shapes, sizes, colors and quantities per unit; since a set of six, longer, triangularly-shaped legs would still be able to perform the above-described function of the four round or rectangular legs of the first and second embodiments. Alternatively, a 3 leg version could be used.

Thus, the scope of the invention should be determined by the appended claims and their legal equivalents, rather than by the examples given.

What I claim is:

1. A folding stool for attaching to the inside of a cabinet door, comprising:

a plate for mounting against said cabinet door and at least one block attached to a side of said plate opposite said cabinet door;

a flat step pivotably attached at a first end to said block;

at least one outside leg pivotably attached to a second end of said step opposite said first end of said step; and at least one inside leg pivotably attached to said step between said first and second ends.

2. The stool of claim 1 wherein there are two outside legs and two inside legs.

3. The stool of claim 1 wherein said inside and outside legs are offset so that they pivot to store in the same plane when said stool is folded against said cabinet door.

4. The stool of claim 1 further comprising a handle attached to said outside leg.

5. The stool of claim 1 wherein said step pivots to a position above said support structure.

6. A folding stool for attaching to the inside of a cabinet door, comprising:

a support structure for attaching to said inside of a cabinet door;

a flat step pivotably attached at a first end to said support structure;

at least one outside leg pivotably attached to a second end of said step opposite said first end of said step;

at least one inside leg pivotably attached to said step between said first and second ends;

at least one linkage member pivotably attached at a first end to said support structure and pivotably attached to said inside leg between said first end and a second end of said linkage member; and a handle structure attached to said outside leg;

said second end of said linkage member being pivotably coupled to one of said outside leg and said handle structure.

7. The stool of claim 6 wherein said linkage member is pivotably coupled to said outside leg.

8. The stool of claim 6 wherein said linkage member is pivotably coupled to said handle structure.

9. The stool of claim 6 wherein there are first and second outside legs, first and second inside legs and first and second linkage members, said first inside leg being pivotably coupled to said step at a first end and pivotably coupled to said first linkage member at a position removed from said first end of said first inside leg, said second inside leg being pivotably coupled to said step at a first end and pivotably coupled to said second linkage member at a position removed from said first end of said second inside leg, said first and second outside legs being pivotably coupled to said step at said second end of said step such that the distance between said outside legs is greater than the distance between said inside legs.

10. A folding stool for attaching to the inside of a cabinet door, comprising:

a support structure for attaching to said inside of a cabinet door;

a flat step pivotably attached at a first end to said support structure;

at least one outside leg pivotably attached to a second end of said step opposite said first end of said step;

at least one inside leg pivotably attached to said step between said first and second ends;

at least one linkage member pivotably attached at a first end to said support structure and pivotably attached to said inside leg between said first end and a second end of said linkage member; and a handle structure attached to said outside leg;

said second end of said linkage member being pivotably coupled to one of said outside leg and said handle structure.

11. A folding stool for attaching to the inside of a cabinet door, comprising:

a support structure for attaching to said inside of a cabinet door;

a flat step pivotably attached at a first end to said support structure;

first and second outside legs pivotably attached to a second end of said step opposite said first end of said step;

first and second inside legs pivotably attached to said step near a midpoint between said first and second ends;

first and second linkage members pivotably attached at a first end to said support structure and pivotably attached to said first and second inside legs, respectively, between said first end and a second end of said linkage members; and a handle structure attached to said outside leg;

said second end of said linkage members being pivotably coupled to one of said outside legs and said handle structure.

* * * * *